US007555871B1

(12) United States Patent
Neal

(10) Patent No.: US 7,555,871 B1
(45) Date of Patent: Jul. 7, 2009

(54) WINDOW FRAMING SYSTEM FOR SLIDING WINDOWS

(75) Inventor: Murray L. Neal, Fresno, CA (US)

(73) Assignee: Guardian, LLC, Missoula, MT (US)

( * ) Notice: Subject to any disclaimer, the term of this patent is extended or adjusted under 35 U.S.C. 154(b) by 431 days.

(21) Appl. No.: 11/051,612

(22) Filed: Feb. 3, 2005

(51) Int. Cl.
*E06B 3/46* (2006.01)
*E05D 15/06* (2006.01)

(52) U.S. Cl. ..... 52/204.51; 52/207; 49/409; 49/410

(58) Field of Classification Search ..... 52/204.57, 52/204.5, 207, 204.6, 204.591, 204.51, 243.1; 49/501, 504, 458, 409, 410; 16/94 R, 96 R; 384/26, 42; 4/607
See application file for complete search history.

(56) References Cited

U.S. PATENT DOCUMENTS 2,950,756 A * 8/1960 Moloney ..... 160/91
3,097,401 A * 7/1963 Riegelman ..... 49/425
3,302,354 A * 2/1967 Mermell ..... 52/476
3,530,618 A * 9/1970 Grossman ..... 49/501
3,975,881 A * 8/1976 Ninowski, Jr. ..... 52/775
4,229,905 A * 10/1980 Rush ..... 49/143
4,398,373 A * 8/1983 Mancuso ..... 49/425
4,532,743 A * 8/1985 Miller et al. ..... 52/207
4,630,400 A * 12/1986 Hsieh ..... 49/425
4,674,246 A * 6/1987 Giguere ..... 52/204.51
4,815,246 A * 3/1989 Haas ..... 52/207
4,956,952 A * 9/1990 Bancroft ..... 52/207
4,958,468 A * 9/1990 Nolan ..... 52/204.51
4,967,507 A * 11/1990 Visnic et al. ..... 49/504
5,103,589 A * 4/1992 Crawford ..... 49/125
5,598,606 A * 2/1997 Jacobs ..... 16/93 R
5,907,890 A * 6/1999 Redaelli ..... 16/96 R
5,927,017 A * 7/1999 Jacobs et al. ..... 49/410
6,067,760 A 5/2000 Nowell
6,098,355 A * 8/2000 Li ..... 52/212
6,131,340 A * 10/2000 Clark et al. ..... 49/410

(Continued)

OTHER PUBLICATIONS

Reid Tool Supply Company® "Reid's For Your Needs"$^{SM}$ Reid Tool—Spring 2004 Catalog (www.reidtool.com), (8 pages).

(Continued)

*Primary Examiner*—Robert J Canfield
*Assistant Examiner*—Jessie Fonseca
(74) *Attorney, Agent, or Firm*—Blakely, Sokoloff, Taylor & Zafman, LLP

(57) ABSTRACT

A number of elongated and preferably extruded periphery pieces are described that have essentially the same shape in cross-section. Each piece has a first channel behind a second channel. The first half of the window may slide in the first channel, and the second channel is to receive a second half of the window which may be fixed. A number of elongated and preferably extruded glazing frame pieces are used each having a glazing channel on one side and a section on an opposite side to be fitted into one of the periphery pieces. The glazing frame pieces also have essentially the same shape in cross-section. A number of glazing stop pieces, each of which is to be secured to a respective one of the glazing frame pieces, are provided. These glazing stop pieces also have essentially the same shape in cross-section. Other embodiments are also described and claimed.

17 Claims, 11 Drawing Sheets

U.S. PATENT DOCUMENTS

| | | | | |
|---|---|---|---|---|
| 6,408,574 | B1 * | 6/2002 | Farrar et al. | 49/375 |
| 6,409,868 | B1 | 6/2002 | Edger | |
| 6,427,398 | B1 | 8/2002 | Levine et al. | |
| 6,434,905 | B1 * | 8/2002 | Sprague | 52/474 |
| 6,622,441 | B2 | 9/2003 | Miller | |
| 6,826,871 | B2 | 12/2004 | Morton et al. | |
| 6,832,449 | B2 * | 12/2004 | Rennetaud et al. | 49/120 |
| 2003/0110696 | A1 * | 6/2003 | Rennetaud et al. | 49/120 |

OTHER PUBLICATIONS

Reid Tool Supply Company® "Reid's For Your Needs"SM Reid Tool—Spring 2004 Catalog, Thompson™ 60 Case® Linearace® Shafts and Pacific Bearing Simplicity™ Linear Bearings, (www.reidtool.com), (4 pages).

U.S. Patent Application entitled "Explosion Resistant Window System", U.S. Appl. No. 10/241,906, filed Sep. 12, 2002, Inventor: Murray L. Neal.

"Excel™ Self-Aligning Bearings and Powertrax™ LBB Bearings", Excel™ Bearings, Excel™ Inch Self-Aligning Bearings and Pillow Blocks Technical Data, Mar. 17, 2009, Internet Search at: www.nookindustries.com/pdf/NookInchLinear.pdf, (pp. 229-237).

"LinTech Positioning Components", LinTech, CA, USA, Nov. 2007, (64 pages).

"LM76 Linear Motion Bearings", Roller Bearings Pillow Blocks, LM76 Linear Motion Bearings, MA, USA, Sep. 2005, (8 pages).

* cited by examiner

WINDOW FRAMING SYSTEM FOR SLIDING WINDOWS

An embodiment of the invention relates generally to frames that support glazings for sliding windows, and more specifically, to an improved primary frame for supporting security glazings, e.g. glazings that are designed to mitigate explosive blasts. Other embodiments are also described and claimed.

BACKGROUND

In an increasingly violent society, businesses and government institutions are subject to a greater number of threats against both life and property. Such threats may be in the form of ballistic threats, explosive blasts, forced entries, as well as others. Security measures have been taken to protect against such threats. These include the installation of special windows that have increased strength, to withstand an attack. For example, windows that have security glazings that can resist certain explosive blasts, ballistic threats, and/or forced entry threats are being specified in new commercial, as well as industrial buildings. Such windows may also present better resistance to natural disasters such as hurricanes, tornadoes, and severe storms.

Conventional windows that call for security glazings have a primary frame to secure a glazing unit, within a defined casement opening of a building, for example. The frame is referred to as a "primary" frame because it may be the only frame that is needed to close the given opening between a "threat side" and a "safe side". Where the threat side is outside of the building, and the safe side is inside the building, the primary frame serves not only to secure the glazing, but to also weatherproof the opening.

BRIEF DESCRIPTION OF THE DRAWINGS

The embodiments of the invention are illustrated by way of example and not by way of limitation in the figures of the accompanying drawings in which like references indicate similar elements. It should be noted that references to "an" embodiment of the invention in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

Figure 1:
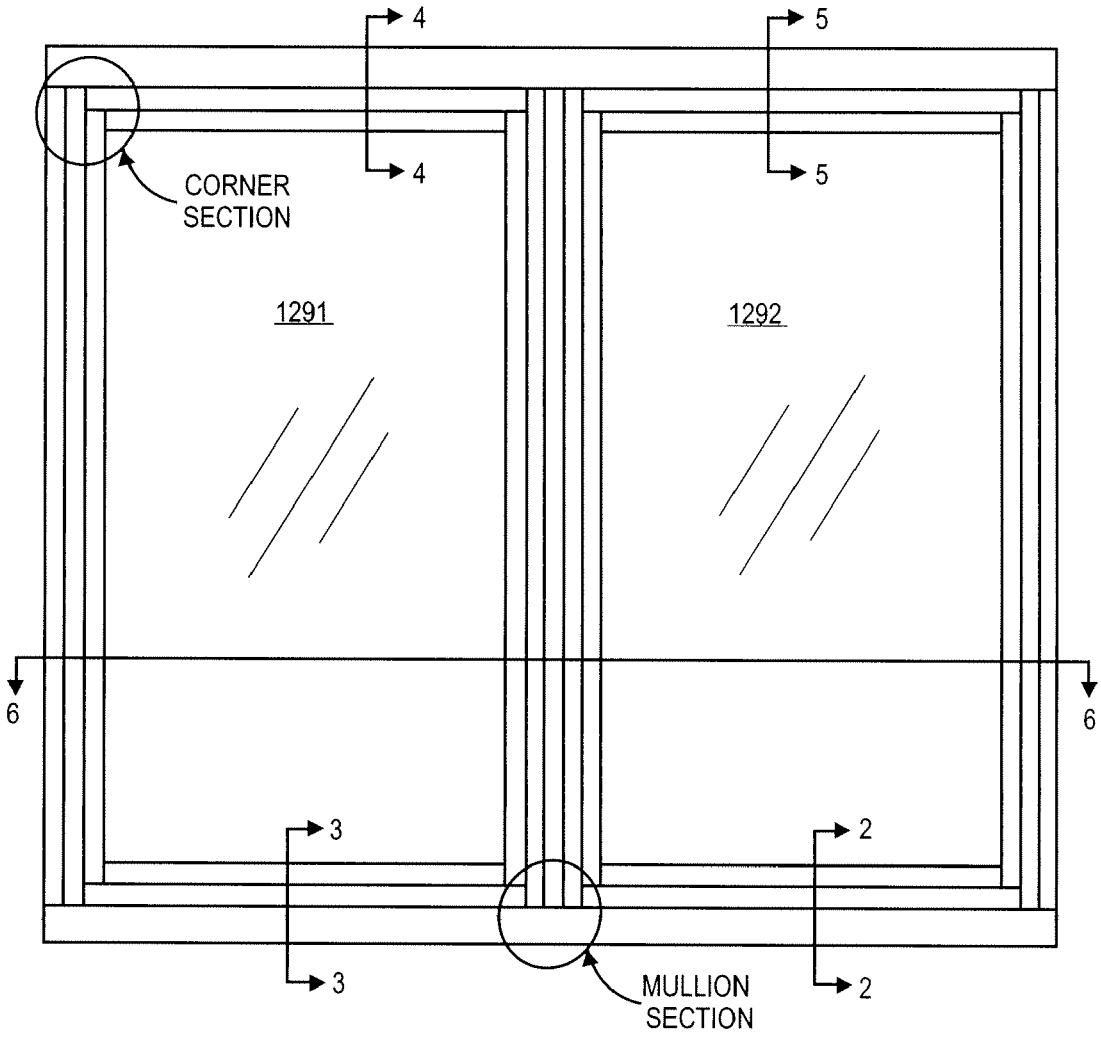
FIG. 1 is an elevation view from the threat side of a blast resistant sliding window, according to an embodiment of the invention.
Figure 5:
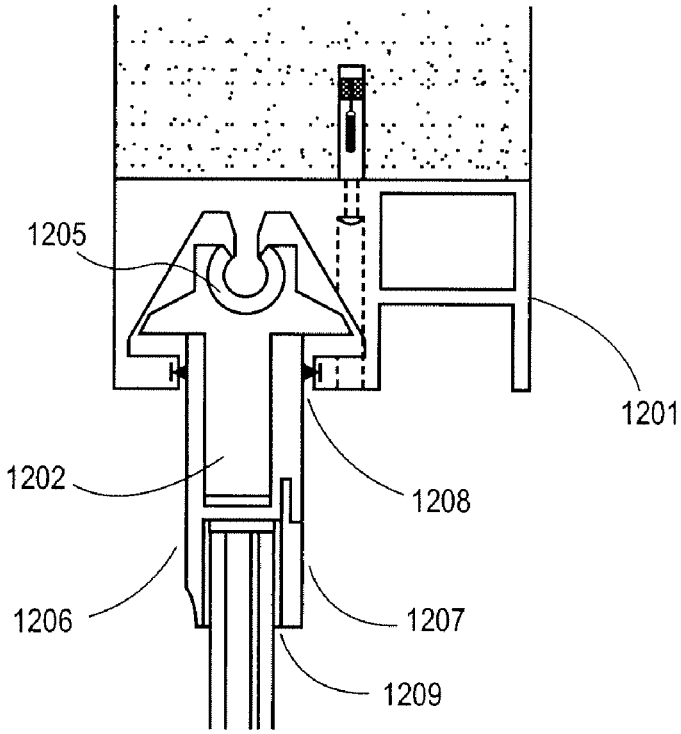
FIG. 5 is a sectional view of the window head at the operable half.

FIG. 1 shows a threat side elevation view of a blast resistant window, according to an embodiment of the invention. In this embodiment, the window has two halves, where each half includes a separate glazing that has been framed and installed within channels of the base pieces of the frame. In this example, the left glazing 1291 is fixed in place, while the right glazing 1292 is operable in that it can be opened and closed by a user sliding it horizontally to the left and right, behind the left glazing. The framing system used for the window as explained below has an advantageous, modular design that allows sharing of structural frame pieces among different types of windows, as well as among the different sides of a window frame. For example, the modular designs of glazing frame and glazing stop pieces allows them to be used, with relatively minor changes, at most, in a number of different applications including left and right jamb sections, mullion sections, as well as the head and sill sections of the window. This allows a single extrusion production line to be used, using a single die having orifices that define the desired cross-section of a beam, where this beam is then cut at different points along its longitudinal axis to form a number of pieces that will be combined to form one or more window frames. The cross-section is designed so that it can be reusable in the different applications. Although extrusion is currently the preferred technique for manufacturing the beams, other types of metal forming may be used to create the different pieces of a window frame having the cross-sectional structure illustrated and described here.

Figure 6:
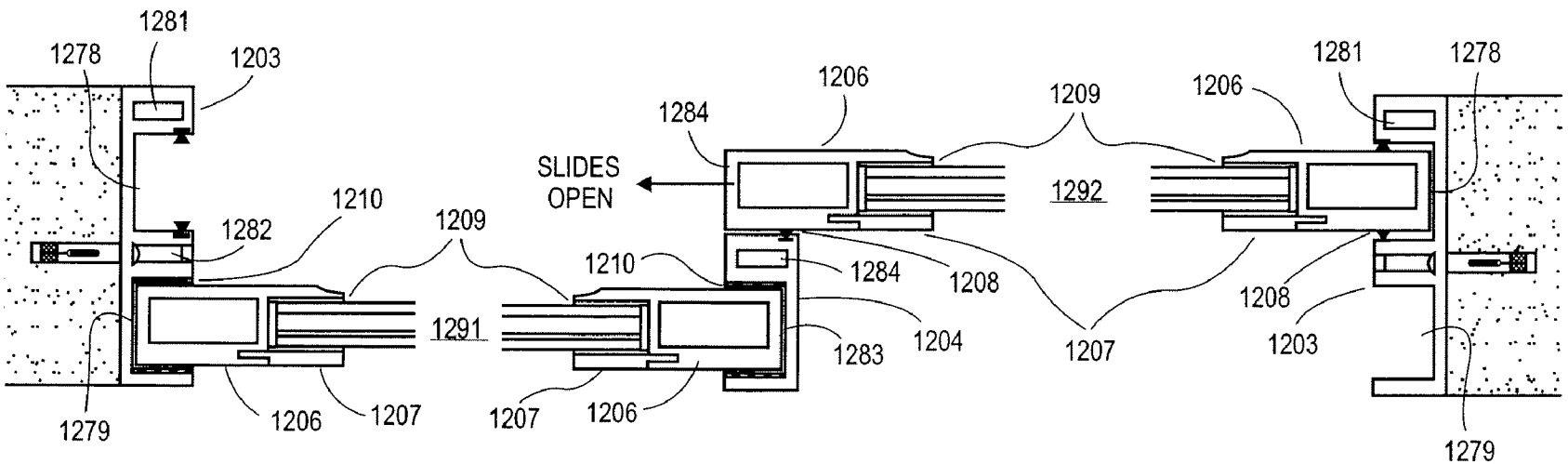
FIG. 6 shows a sectional view of the left and right jamb sections and a vertical mullion of the window.

Different sectional views of the example dual light window of FIG. 1 are illustrated in FIGS. 2-6. The sectional views show cavities and other aspects of a frame piece that in most cases may run the full length of the piece. The example dual light window has for its sill section a single base piece 1201 running longitudinally the entire length of the window, with cross-sections shown in FIGS. 2 and 3. Similarly, at the head, the window has another essentially identical base piece 1201 running the length of the window, with cross-sectional views shown in FIGS. 4 and 5. Note how essentially the same frame pieces may be used for the sill and head sections, as well as the jamb sections (FIG. 6).

Figure 2:
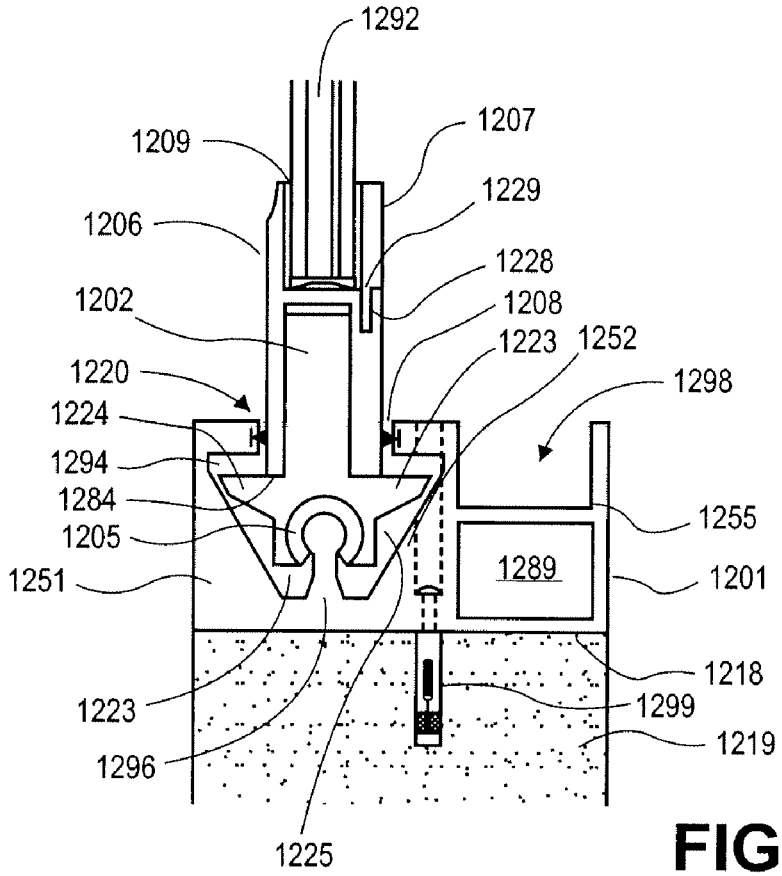
FIG. 2 is a sectional view of a windowsill showing a glazing installed in the sliding or operable half of the window.
Figure 4:
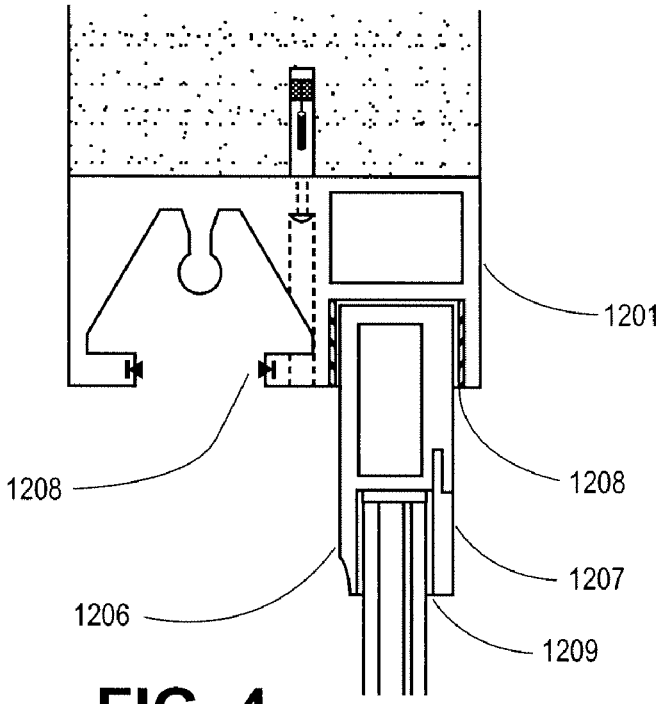
FIG. 4 is a sectional view of a window head at the fixed half of the window.
Figure 3:
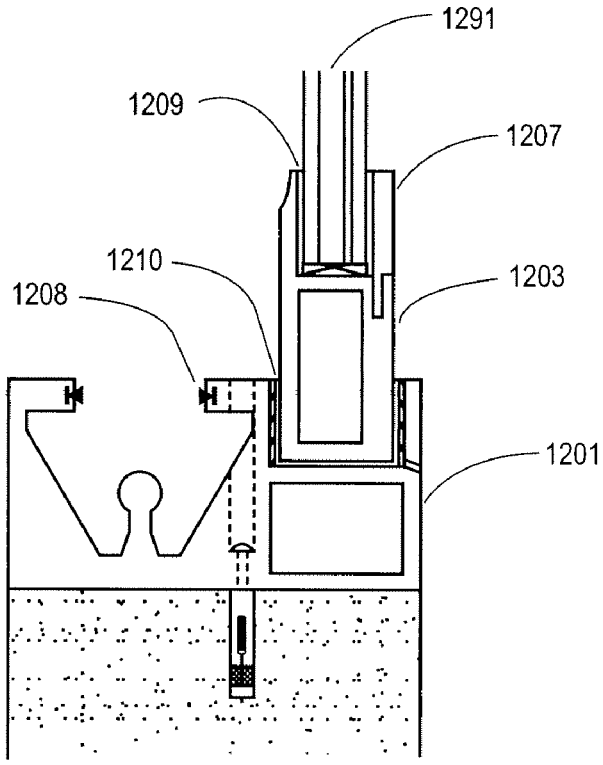
FIG. 3 is a sectional view of the windowsill showing another glazing installed in a fixed half of the window.

Starting with FIG. 2, a sectional view of a sill section of the window is shown, with the right glazing 1292 positioned fully closed. The sill section is composed of a base piece 1201 (also referred to as a frame surround) and a pillow block piece 1202. The base piece 1201 is an elongated frame element whose back side 1218, once installed within an opening of a building, faces and may rest against a horizontal part of the building structure (in this case a horizontal, concrete block 1219 that in part defines the opening in which the window is installed). The base piece 1201 has a first channel 1294 formed in its front side 1220 in which a rail 1296 runs in a longitudinal direction of the base piece. An operable half of the sliding window is to slide on this rail 1296. The base piece 1201 also has a second channel 1298 formed in the front side 1220 and located in front of the first channel, to receive therein another half of the window, in this case the fixed half. Although in the examples shown the windows are dual light windows, the structures of the frame pieces shown may also be used with windows having more than two lights. Accordingly, any reference to a "half" of a window should not be limited to dual light windows.

The pillow block piece 1202 has a cavity formed in a back side 1223 of the pillow block and that runs also in the longitudinal direction, with a linear bearing 1205 that is fitted in the cavity. The bearing is preferably made of a Teflon material or a plastic material that is self lubricating. The pillow block piece 1202 is to be installed onto the rail 1296, so that the bearing is in contact with the rail as shown. The bearing helps better support the load of the glazing 1292 on the rail, as the window is opened and closed. Additionally, it provides resistance against pullout during an explosive blast's positive phase or other attack which creates a torsion event (a sort of twisting and pulling action combined) upon the framed glazing, relative to the anchored base pieces.

In this example, the rail 1296 is composed of a shaft that is spaced upwards from a bottom of the first channel 1294 as shown. The shaft in this example is round, and the bearing 1205 has a C-shaped cross-section that mates with the surface of the shaft, preferably leaving about a 0.005-0.010 inch gap between the bearing and the shaft once installed. That combination allows the use of certain off the shelf linear bearings, while promoting better resistance to wear. For the sill condition, the bearing 1205 has an opening 1284 that is oriented downward as shown. This opening 1284 is smaller than the diameter of the round shaft, to help prevent the framed glazing 1292 from being pulled completely off of the rail while the window is experiencing a blast. The opening 1284 is also smaller than the width of the post, to help dirt and debris that may be lying on top of the shaft to fall over the sides of the shaft and down to the bottom of the first channel 1294.

To install such a window, the bearing 1205 is first installed in its laterally open cavity within the pillow block piece 1202, by, for example, squeezing the bearing laterally and then simultaneously sliding it longitudinally into the cavity, where it will be held in place by a press fit against the cavity wall. The pillow block piece 1202 is then inserted longitudinally into the first channel 1294 of the base piece 1201, while aligning the cavity and bearing to slide over the shaft. At this point, the glazing 1292 and its glazing frame piece 1206 may or may not be attached to the pillow block piece 1202. Next, the base piece 1201 is anchored to the adjacent building support structure by, for example, placing the back side 1218 against a horizontal concrete block 1219 and then installing a number of concrete anchor screws 1299 laterally through the base piece 1201 at several locations along its length. The desired center spacing of these anchors is dependent on the specified blast rating for the window. For example, the anchors may be started off from each edge by about one and one-half inches, and thereafter at a spacing of about three to six inches depending on the desired blast resistance (smaller spacing provides greater blast resistance). As mentioned above, each of the base and pillow block pieces may be separate extrusions so that the first and second channels and the rail are integral to the base extrusion, while the pillow block piece has its cavity integrally formed. These extrusions may be aluminum extrusions.

Still referring to FIG. 2, to provide further protection against blast, the pillow block piece 1202 is configured with first and second wings 1223, 1224 that extend from opposite sides of the pillow block piece as shown. The wings are tapered downward as shown, so as to provide additional space within the first channel 1294 to widen the side walls 1251, 1252 of the base piece 1201. To strengthen the base piece 1201, the inner and outer side walls of the base piece are tapered so that they widen as they proceed downward, in the sill section shown in FIG. 2. The inner side wall 1252 is closer than the outer side wall 1251 to the second channel 1298. One or both of the wings 1223, 1224 may have a cutout 1225 that is primarily for weight saving purposes. The side walls 1251, 1252 of the base piece 1201 extend upward and around the wings, respectively. The top portions of the inner and outer side walls, also referred to as flanges, may be fitted with respective weather resistant felt/plastic strips 1208 that are in contact with opposite sides of a glazing frame piece 1206. In addition to weather proofing, these strips 1208 help center the glazing frame piece 1206 (and its associated pillow block piece 1202) within the first channel 1294.

The glazing 1292 is mounted to the pillow block piece 1202 via a glazing frame piece 1206. The glazing frame piece 1206 has a glazing channel on its top side to receive a top, bottom, left, or right side of a rectangular glazing (depending on which side of the window it is being used). The bottom side of the glazing frame piece 1206 has a section that is hollow and is to be fitted onto an upper section of the pillow block piece 1202. Each glazing 1291, 1292 should be secured against the walls of its respective channel by preferably some type of adhesive tape that has sealing properties, such as a double-sided, closed cell, high density-very high bond (HD-VHB) foam tape 1209. To secure the glazing 1292 in its channel, a glazing stop piece 1207 is provided that once installed sandwiches the glazing 1292 as shown, in its channel. In this case, a slot 1228 is formed near the outside of the channel to receive a finger 1229 of the glazing stop piece 1207 through a press fit. The outside surfaces of the stop piece 1207 and the frame piece 1206 are shaped and sized so that the operable half of the window (containing the glazing 1292) can slide past the fixed half (containing the glazing 1291); see FIG. 6. Other ways of securing the glazing 1292 in its channel may alternatively be used.

Still referring to the sectional view of FIG. 2, the base piece 1201 may also have a cavity 1289 formed below the second channel 1298, for purposes of not just saving weight, but also to receive one or more shear blocks (not shown) for installations that call for additional blast protection. There may also be a weep hole 1255 formed on the outer surface, in this case threat side, of the base piece 1201 to allow any rain or condensation that accumulates in the second channel 1298 to be drained.

Figure 7:
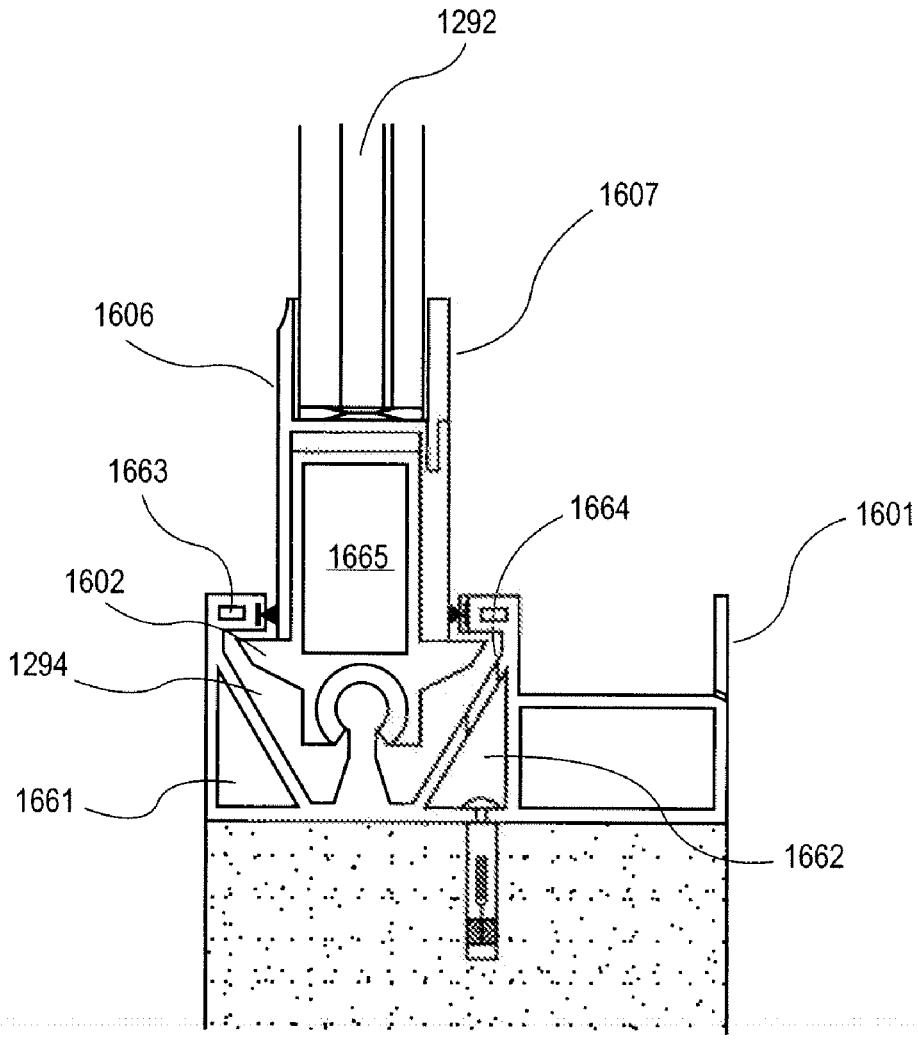
FIG. 7 is a sectional view of the sill portion of a sliding window, showing the operable half, according to another embodiment of the invention.

Another embodiment of the invention is depicted in FIG. 7. This embodiment is a lighter weight version of the embodiment shown in FIG. 2, and has less blast resistance, due to additional weight-saving cavities 1661-1665 and thinner walls. The additional weight saving cavities 1661, 1662 are formed in the side walls of the base piece on either side of the channel 1294, while the cavities 1663, 1664 are formed in the flanges. The cross-sections of the remaining pieces in the version of FIG. 7, namely the lightened base piece 1601, lightened pillow block piece 1602 (with a cavity 1665), lightened glazing frame 1606, and lightened glazing stop piece 1607 are essentially identical in shape (but not necessarily dimensions) to their corresponding parts shown in FIG. 2.

Turning now to the jamb and mullion sections of the window shown in the sectional view of FIG. 6, the left and right jamb sections have essentially identical jamb base pieces 1203, having a first longitudinal channel 1278 into which the operable half of the window (in this example containing glazing 1292) may slide, when the window is fully opened. A second channel 1279 is formed in front of the first channel 1278, to receive therein the fixed half of the window (containing, in particular, a glazing frame piece 1206 within the channel 1278 over a weather gasket 1210, to receive the glazing 1291). In the right jamb piece, the second channel 1279 receives the operable half of the window in the fully closed position, and the second channel 1279 that is in front of the first channel 1278 will be left unused. A pair of hollow sections, also referred to as laterally closed cavities, 1281, 1282 are formed next to and on opposite sides of the first channel 1278 that run lengthwise, where these serve to not only reduce weight but also can receive respective shear blocks (not shown) in installations that call for greater blast protection.

The right side jamb piece 1203 shown in FIG. 6 may also have a reglet on one or, in this case, both of the side walls of the channel 1278 that receives a weather resistant felt/plastic strip 1208. A glazing frame piece 1206 lies against the weather strips when the window is in the closed position. Note how this glazing frame piece 1206 is essentially identical in cross-section shape to the one used for the head and sill sections (FIGS. 2-5), except that in the latter, a distal end 1284 has been cutoff, or not formed during an extrusion for example, to reveal the open end into which the pillow block piece 1202 is fitted.

Another aspect of the sectional view in FIG. 6 is the mullion piece 1204 that may be extruded, or may be obtained by cutting off the rear section of a right jamb base piece 1203 that defines the channel 1278 and the cavity 1281. This leaves the mullion piece 1204, which has a channel 1283 to receive therein a glazing frame piece 1206 of a fixed half of the window, and a hollow section 1284 next to the channel 1283 that runs lengthwise between the different halves of the window. As suggested above, a shear block (not shown) may be fitted into the hollow section 1284 of the mullion piece to improve blast protection.

Figure 16:
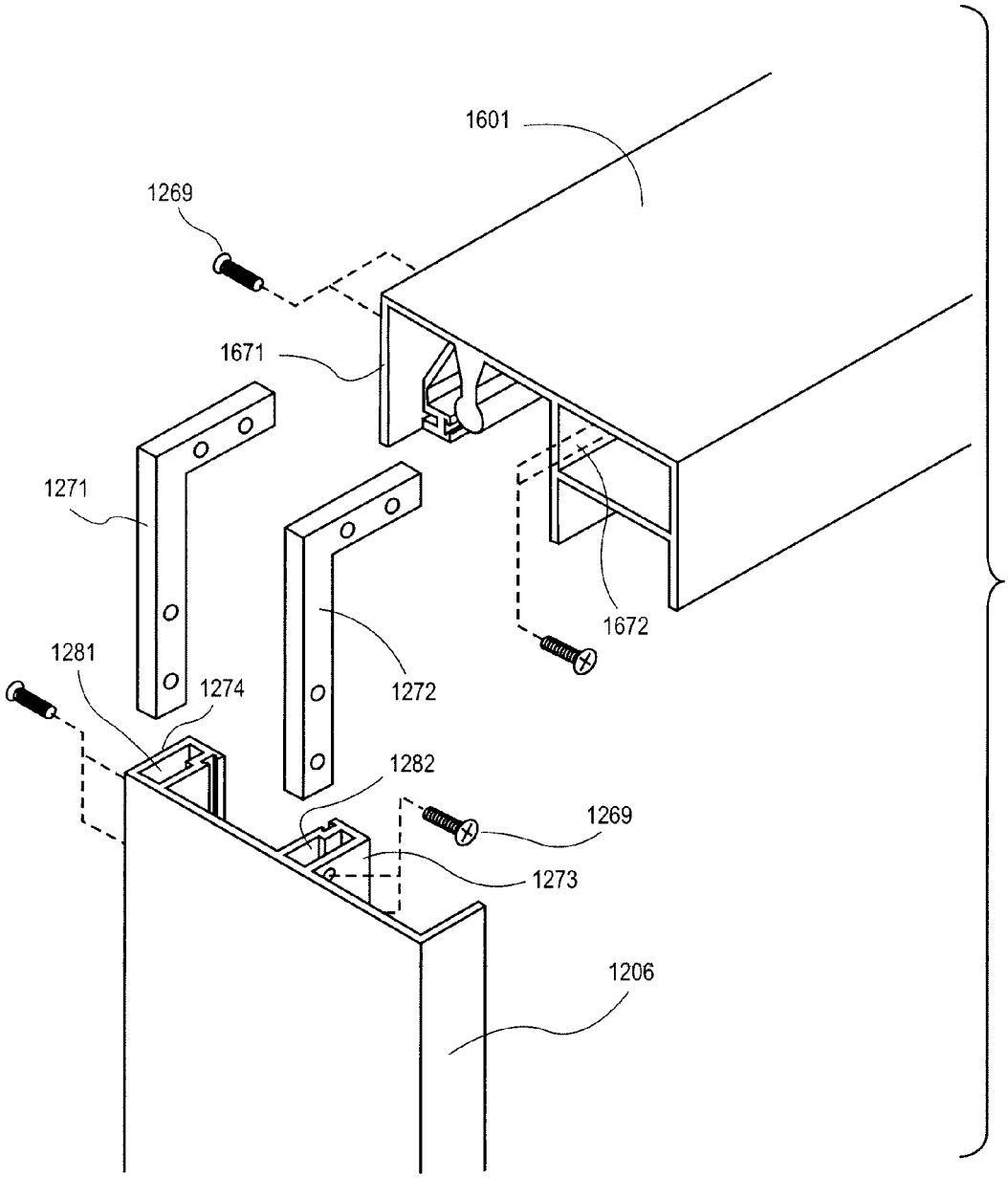
FIGS. 16-18 are elevation views of example corner sections.

A jamb piece 1206 may be attached to a head or sill piece 1201 at a corner section as, for example, depicted in FIG. 16. The jamb and head pieces in this example are to be joined to each other at a ninety degree angle using corner keys, in this case, a pair of right angle shear blocks 1271, 1272. One end of each shear block is inserted longitudinally into a respective cavity 1281, 1282 in the jamb piece, while another end is inserted into a respective cavity 1661, 1662 of the head or sill piece 1601 (see FIG. 7). Portions of the ends of the jamb piece may need to be hogged out as shown, to make room for the corner keys. The right angle shear blocks are then secured in that position by installing one or more fasteners 1269 as shown, which pass through their respective fastener openings in front facing and rear facing side walls 1273, 1274, respectively, of the cavities 1282, 1281. One or more fasteners 1269 may also be inserted through respective outer side walls 1671, 1672 of the channel 1294 in the head or sill piece 1601.

Figure 17:
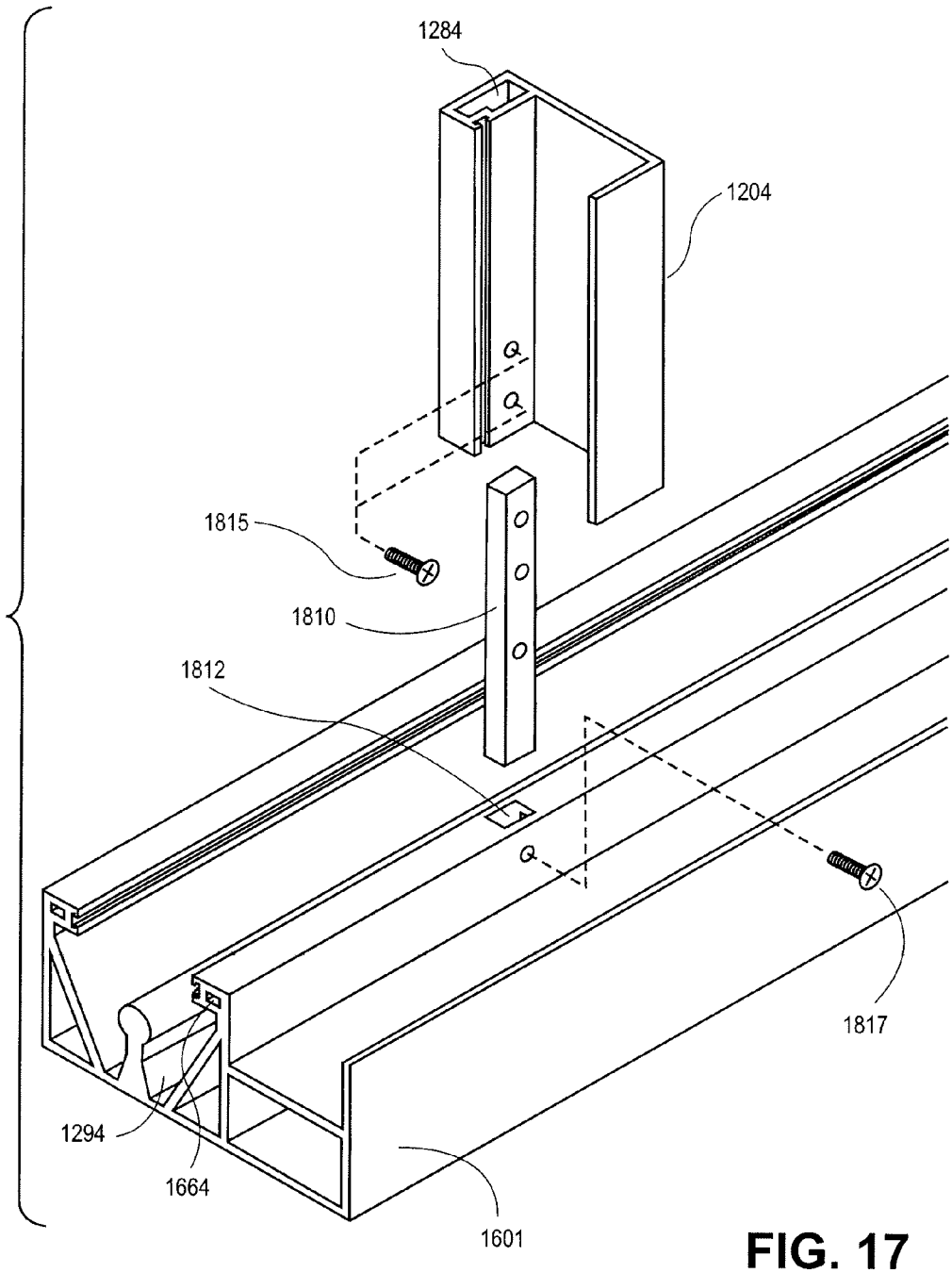

Turning now to FIG. 17, an elevation view of a mullion corner section of the embodiment of FIG. 1 is shown. This corner is an example of how to join a fixed, vertical mullion piece 1204 with a cavity 1284 (see FIG. 6) to a horizontal sill piece 1601 (see FIG. 7). What is not shown in FIG. 17 is the glazing 1291 which in this case forms part of the fixed half of the window (see FIG. 6). The vertical mullion piece 1204 and the horizontal sill piece 1601 are joined in this case using a straight shear block 1810 that is inserted at one end longitudinally into the cavity 1284 and at an opposite end into an opening 1812 that is formed in a top facing surface of the sill piece 1601 and extends laterally into the longitudinal cavity 1664. In some cases, this opening 1812 may extend even further, past cavity 1664 and down into the channel 1294 (see FIG. 7). Fasteners 1815, 1817 are installed through their corresponding and appropriately placed openings in the front facing side wall of the cavity 1284 and a front facing side wall of the channel 1294. As an alternative, the fasteners 1815 may be installed through corresponding holes in the rear facing side wall of the cavity 1284.

Figure 8:
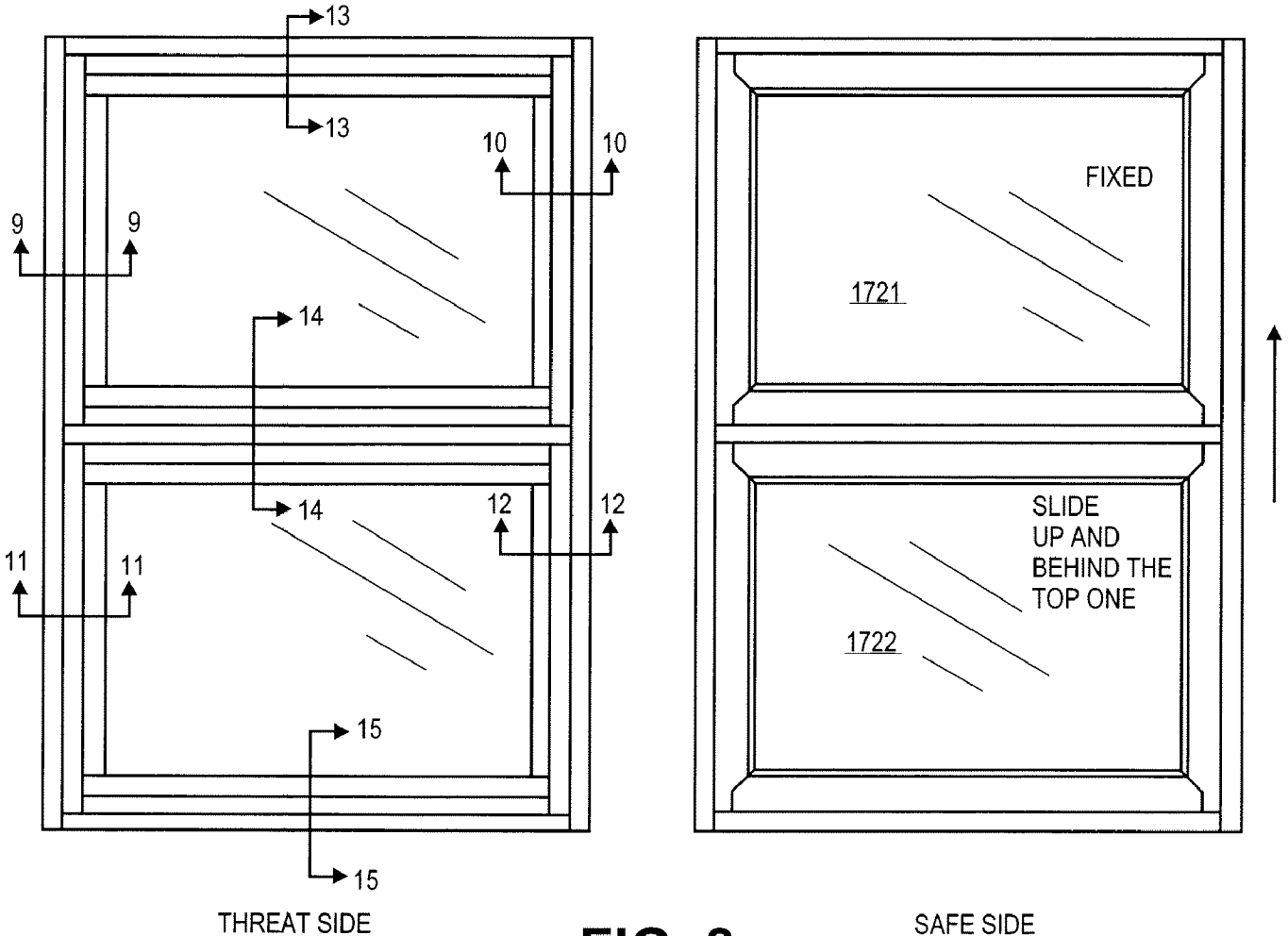
FIG. 8 depicts threat and safe side elevation views of a single hung window, according to another embodiment of the invention.

Turning now to FIG. 8, threat side and safe side views of a blast resistant, single hung window is shown according to another embodiment of the framing system. This is referred to as a single hung window, because one half of the window remains fixed, while the other half slides vertically up and down, to open and close the window. This type of window also has a balance (not shown) being either spring-loaded or a spiral piston that assists in lifting the window. The sectional views of the frame pieces illustrated here, in FIGS. 9-15, are not just applicable to a single hung window, but also to other types of sliding windows having, for example, more than two lights.

Figure 9:
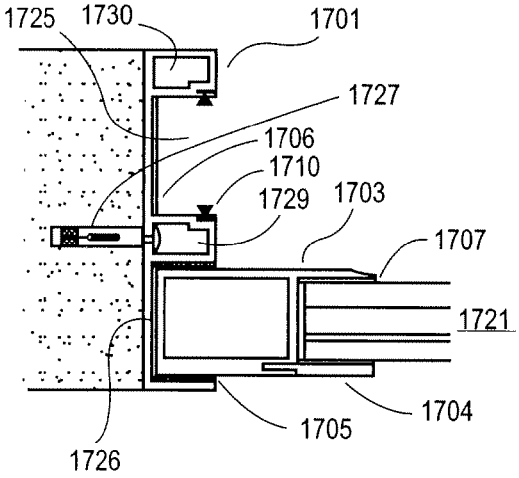
FIGS. 9-15 are sectional views of the jamb, head, horizontal mullion, and sill sections of the window of FIG. 8.
Figure 11:
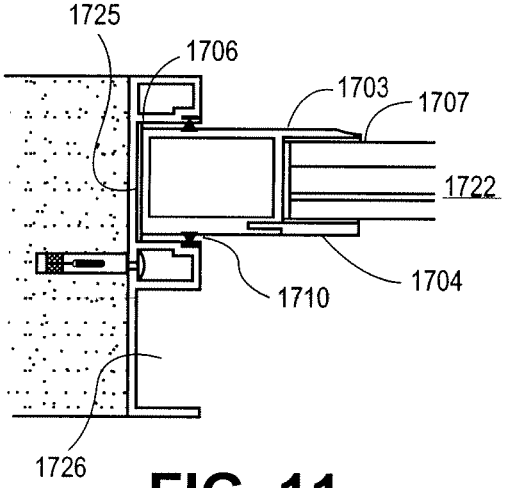

Turning now to FIG. 9, a sectional view of the single hung window, taken through the upper left jamb section bearing a glazing 1721 is shown. The jamb base piece 1701 once again has a first channel 1725 that is formed behind a second channel 1726, in a side of the piece 1701 that is opposite the one that faces a vertically oriented portion of the building support structure to which it is anchored by one or more fasteners 1727. These channels are separated by a laterally closed cavity 1729 that also runs the full length of the jamb piece 1701. A second, laterally closed cavity 1730 is formed in the jamb piece 1701, behind the first channel 1725, also running full length. One or both of these cavities 1729, 1730 may be fitted with shear blocks (not shown) to provide further blast resistance. As to the channels 1725, 1726, these are shaped and sized so that a glazing frame piece 1703 can fit therein. Thus, for the upper left jamb section shown in FIG. 9, a glazing frame piece 1703 is fixed within the channel 1726. In contrast, the lower right jamb section of the window shown in FIG. 11, shows another glazing frame piece 1703 (that of the operable half) slidingly fitted in the first channel 1725. To allow easier sliding motion and greater wear resistance, the bottom of the base piece channel 1725 may be lined with a material such as ultra-high molecular weight plastic (UHMWP) channel glide 1706. For the fixed half of the window, the glazing frame piece 1703 may be fitted into the channel 1726 over an Ethylene Propylene Diene Monomer (EPDM) or elastomer weather gasket 1705 that lines not only the bottom of the channel 1726 but also its side walls as shown.

The glazing frame piece 1703 has a channel to receive therein a corner of a glazing 1721, with a slot to receive a finger of a glazing stop piece 1704, much like the components described above in connection with FIGS. 2-7. An adhesive/sealant tape 1707 (such as double-sided, closed cell high density, very high bond HD-VHB foam tape) may be sandwiched in between the glazing 1721 and one or both side walls of the glazing channel in the frame piece 1703. A pair of weather strips 1710 may be fitted into their respective grooves that are formed near the ends of the side walls of the first channel 1725 running the full height of the window (FIGS. 9-12). Opposite sides of the glazing frame piece 1703 that makes up the operable half of the window, rests in contact with these two weather strips 1710, while the window slides up and down between a closed and open position, to provide weather proofing along the jamb sections.

Figure 13:
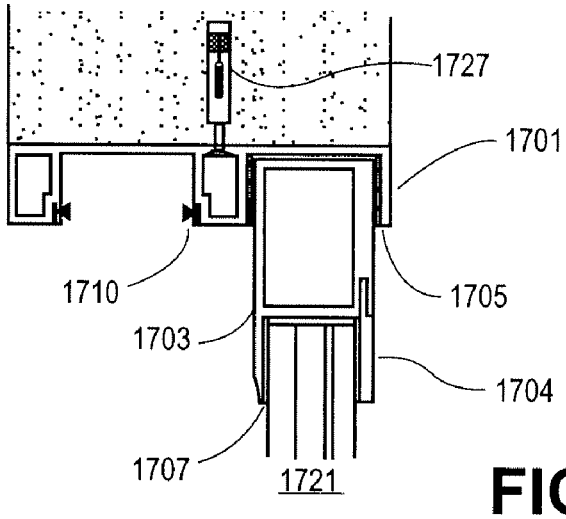
Figure 14:
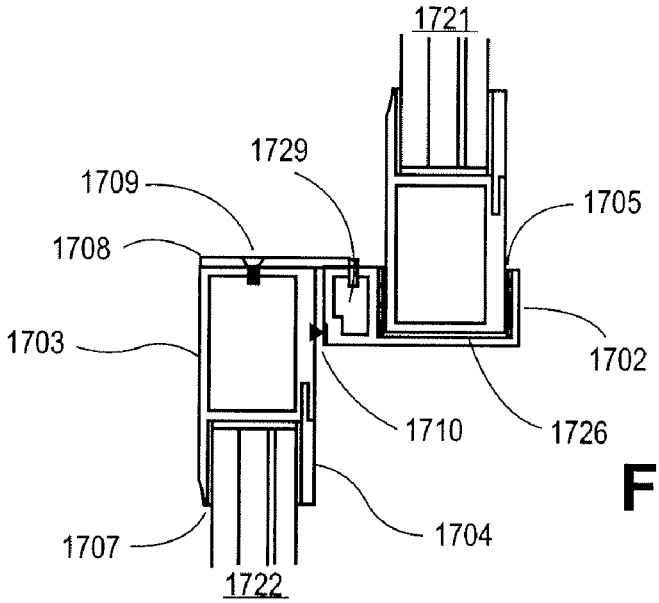
Figure 15:
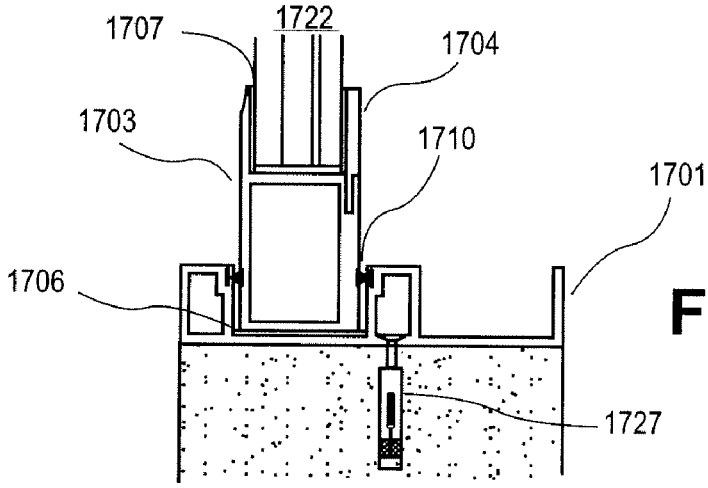

Turning now to FIGS. 13 and 15, sectional views of the head and sill portions of the window are shown, with the window being fully closed. Once again, the same type of frame piece 1701 may be used for both the head and sill sections as used for the jamb sections. This base piece 1701 is secured at the head to a horizontal building support structure using fasteners 1727 and similarly at the sill portion (FIG. 15). FIG. 14 shows a sectional view of a horizontal mullion of the window, showing, with the window in the fully closed position, sectional views of the glazings 1721, 1722 held by their respective horizontally oriented frame pieces 1703.

Figure 10:
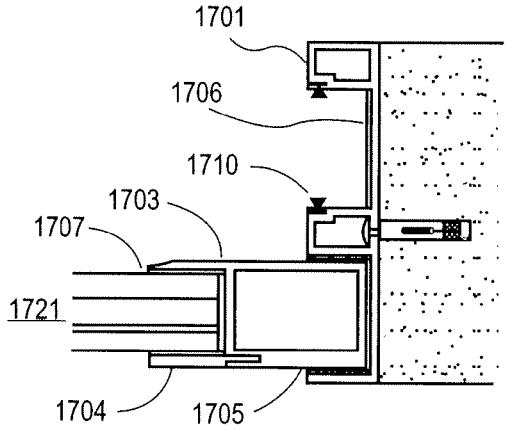
Figure 12:
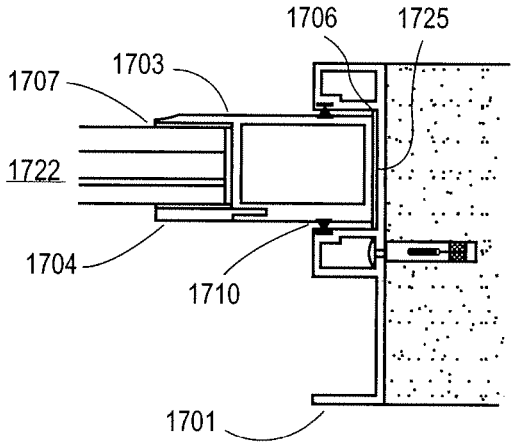

The foregoing FIGS. 9-15 illustrate that each glazing 1721, 1722 is surrounded at its perimeter by four glazing frame pieces 1703 that are attached together at the corners (not shown) to form a single, framed glazing, one for the operable and another for the fixed half. The operable half is installed into a pair of opposing first channels 1725 in the jamb sections (FIGS. 11 and 12). The fixed half is installed into a pair of opposing second channels 1726 of the jamb sections (FIGS. 9 and 10). The remaining parts of the window frame can then be assembled, by attaching the head and sill base pieces 1701 (FIGS. 13 and 15) to the left and right jamb sections. This "unitized" window may then be secured to the building support structure by installing a number of fasteners 1727 between the first and second channels 1725, 1726, along the length of and laterally through each base piece 1703, into the building support structure wall, as required by the specified threat resistance.

It should be noted that in FIG. 14, the horizontal mullion of this example single hung window has a mechanism that rigidly couples the first and second halves of the window to each other, when the window is in the fully closed position. A retaining hook piece 1708 runs longitudinally, in a width direction of the window, and is to be inserted at one end into a longitudinal slot that opens into a laterally closed hollow section 1729 that is formed adjacent to the channel 1726 in a mullion base piece 1702. At another end, the hook piece 1708 is secured, via, e.g. a metal screw 1709, to a top face of the glazing frame piece 1703 of the operable half of the window. Note that the mullion piece 1702 may be viewed as essentially the same as a jamb piece 1701, except for the first channel 1725 and the cavity 1730 having been either not formed or cutoff from the piece. In other words, both in terms of cross-sectional shape and, in this case, dimensions, the mullion piece 1702 may essentially be the same as the part of the jamb piece 1701 that includes the channel 1726 and cavity 1729 (see FIG. 11, for example). However, the mullion piece 1702 also contains a groove for weather strip 1710, the groove being formed longitudinally on a wall of the cavity 1729 that faces the other half of the window, in this case the operable half that contains glazing 1722. It is the glazing frame piece 1703 of the operable half of the window that is in contact with the weather strip 1710, with the window in a fully closed position as shown in FIG. 14.

Figure 18:
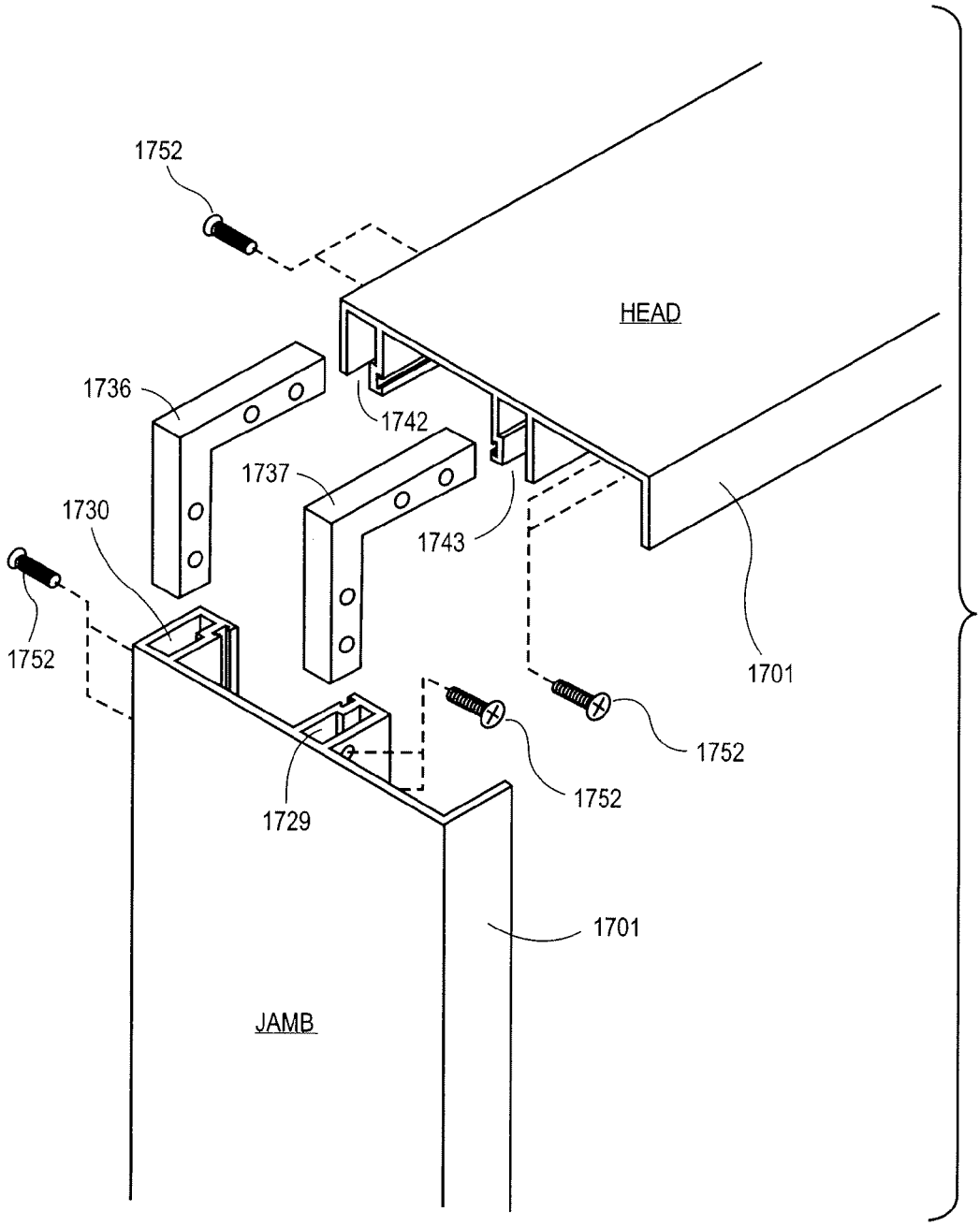

Turning now to FIG. 18, an elevation view of a corner section of the embodiment of FIG. 8 is shown, where substantially identical (in cross-section) jamb and head pieces 1701, 1701 are joined to each other at a right angle. Once again, a pair of right angle shear blocks 1736, 1737 are inserted at one end into their respective cavities 1730, 1729 in the jamb piece, and at another end into like cavities in the head piece. Note, however, the jamb cavities 1730, 1729 are laterally closed, while those of the head piece have an opening 1742, 1743 that runs longitudinally, possibly the full length of the head piece 1701. Fasteners 1752 (such as screws) are installed though their respective holes in the side walls of the cavities and into the shear blocks, to secure the latter in place.

The invention is not limited to the specific embodiments described above. For example, although the glazing frame pieces 1206 and 1703 both feature a weight saving, laterally closed cavity that may run longitudinally the full length of each piece, as shown in the figures, an alternative here is to have more than one such cavity (for example, adding a longitudinal, separation wall forming exactly two, laterally closed cavities next to each other). Yet another embodiment may be one where there is essentially no such cavity and the glazing frame piece is a solid piece (although this may increase the weight of the window framing system, depending on the material used for the frame piece). Accordingly, other embodiments are within the scope of the claims.

What is claimed is:

1. A frame for a sliding window, comprising:

an elongated base piece and a pillow block piece that together form part of one of a sill section and a head section of the sliding window, the base piece having inner and outer side walls defining a first channel in which a rail runs in a longitudinal direction of the base piece and on which an operable half of the window is to slide, the inner and outer side walls having respective flanges extending laterally inwardly to define a channel opening, the base piece further having a second channel in front of the first channel to receive therein a fixed half of the window, and the pillow block piece having a laterally open cavity running in a longitudinal direction of the pillow block piece, a linear bearing to be fitted in the cavity, and the pillow block piece to be installed onto the rail in the first channel so that the bearing is in contact with the rail and so that a portion of the pillow block piece extends in a vertical direction through the channel opening, the pillow block piece having first and second wings that, when the pillow block piece is installed on the rail, are disposed within the first channel and extend laterally beyond each side of the channel opening so that the pillow block piece is retained vertically within the first channel even if dislodged from the rail.

2. The frame of claim 1 wherein the base and pillow block pieces together form part of the sill section, and the inner and outer side walls extend upward and around the wings, respectively, the inner side wall being closer than the outer side wall to the second channel.

3. The frame of claim 2 wherein inner and outer side walls of the base piece are tapered so that they widen as they proceed downward.

4. The frame of claim 3 wherein each of the inner and outer side walls has a separate cavity that runs longitudinally through the base piece.

5. The frame of claim 3 wherein the base piece is to be anchored to a support structure of a building at a plurality of locations spaced longitudinally along the base piece, through the inner side wall.

6. The frame of claim 1 wherein the rail has a head on a post, the post extending upward from a bottom of the first channel.

7. The frame of claim 6 wherein each of the base and pillow block pieces are extrusions and the first channel, the second channel, the rail, and the cavity are integral to the extrusions.

8. The frame of claim 7 wherein the extrusions are aluminum extrusions.

9. The frame of claim 6 wherein the head is round and the bearing has a C-shaped cross-section.

10. The frame of claim 3 further comprising first and second weather strips fitted to respective channels formed at the ends of the inner and outer side walls of the base piece.

11. The frame of claim 10 further comprising:

a glazing frame piece having a glazing channel on one side, to receive one of a top and bottom of a glazing, and a section on an opposite side to be fitted to the pillow block piece; and a glazing stop piece to be secured to the glazing frame piece and hold the glazing within the glazing channel, wherein the glazing frame piece is to fit over the pillow block piece and remain in contact with first and second weather strip sweeps.

12. The frame of claim 1 further comprising:

a glazing frame piece having a glazing channel on one side, to receive one of a top and bottom of a glazing, and a section on an opposite side to be fitted to the pillow block piece; and a glazing stop piece to be secured to the glazing frame piece and hold the glazing within the glazing channel.

13. The frame of claim 12 wherein each of the base, pillow block, glazing frame, and glazing stop pieces are extrusions and the first channel, the second channel, the rail, and the cavity are integral to the extrusions.

14. The frame of claim 13 wherein the extrusions are aluminum extrusions.

15. The frame of claim 12 further comprising:

another glazing frame piece being of essentially identical shape in cross-section to said glazing frame piece, except that said glazing frame piece has a cutout section that has been removed to allow it to be fitted to the pillow block piece, the another glazing frame piece to receive another glazing and to be installed in the second channel in front of the first channel of the base piece, said glazing frame piece and the another glazing frame piece forming part of the operable and fixed halves, respectively, of the window.

16. The frame of claim 1 further comprising:

a left elongated jamb piece that forms part of a jamb section of the sliding window, the jamb piece having a first longitudinal channel into which the operable half of the window is to slide when the window is fully opened, and a second channel in front of the first channel to receive therein the fixed half of the window.

17. The frame of claim 16 further comprising:

a right elongated jamb piece that is essentially identical in cross-section shape to the left jamb piece, the right jamb piece forms part of another jamb section of the sliding window, the right jamb piece having a longitudinal channel into which the operable half of the window is to slide when the window is fully closed.

* * * * *